US006347781B1

(12) United States Patent
Trangsrud

(10) Patent No.: US 6,347,781 B1
(45) Date of Patent: Feb. 19, 2002

(54) CONCRETE HOLE FORMER WITH EMBEDDED GASKET

(75) Inventor: Julian Trangsrud, Northfield, MN (US)

(73) Assignee: Royal Environmental Systems, Inc., Stacy, MN (US)

( * ) Notice: Subject to any disclaimer, the term of this patent is extended or adjusted under 35 U.S.C. 154(b) by 0 days.

(21) Appl. No.: 09/545,363

(22) Filed: Apr. 7, 2000

(51) Int. Cl.[7] ..... B28B 7/30; B28B 23/00; E01G 15/00

(52) U.S. Cl. ..... 249/11; 249/39; 249/95; 52/20; 52/21

(58) Field of Search ..... 52/20, 21; 249/10, 249/11, 39, 95

(56) References Cited

U.S. PATENT DOCUMENTS

| | | | | | |
|---|---|---|---|---|---|
| 3,758,066 | A | * | 9/1973 | Skinner et al. | 249/95 |
| 3,796,406 | A | * | 3/1974 | Ditcher | 249/11 |
| 3,815,214 | A | * | 6/1974 | Kyle, Sr. | 249/11 X |
| 3,874,063 | A | * | 4/1975 | Skinner et al. | 285/189 X |
| 4,063,582 | A | | 12/1977 | Fischer | |
| 4,159,829 | A | | 7/1979 | Ditcher | |
| 4,278,229 | A | * | 7/1981 | Burlett | 249/11 |
| 4,333,662 | A | * | 6/1982 | Jones | 285/230 X |
| 4,422,994 | A | | 12/1983 | Ditcher | |
| 4,508,355 | A | | 4/1985 | Ditcher | |
| 4,565,347 | A | | 1/1986 | Ditcher | |
| 4,625,976 | A | * | 12/1986 | Gilbert | 52/20 X |
| 4,685,650 | A | | 8/1987 | Ditcher | |
| 4,801,417 | A | | 1/1989 | Ditcher | |
| 4,842,785 | A | | 6/1989 | Daigle et al. | |
| 4,854,543 | A | * | 8/1989 | Daigle et al. | 249/11 X |
| 4,867,411 | A | * | 9/1989 | Dorsey et al. | 249/11 |
| 4,916,799 | A | | 4/1990 | Skinner et al. | |
| 4,941,643 | A | | 7/1990 | Ditcher | |
| 5,303,518 | A | | 4/1994 | Strickland | |
| 5,381,995 | A | | 1/1995 | Del Zotto | |
| 5,413,307 | A | | 5/1995 | Tidwell | |
| 5,540,411 | A | | 7/1996 | Strickland | |
| 5,624,123 | A | | 4/1997 | Meyers | |
| 5,806,829 | A | | 9/1998 | Banks | |
| 5,951,924 | A | | 9/1999 | Malecha | |
| 6,196,517 | B1 | * | 3/2001 | Westhoff et al. | 249/39 X |

* cited by examiner

*Primary Examiner*—Laura A. Callo
(74) *Attorney, Agent, or Firm*—Nikolai & Mersereau, P.A.

(57) ABSTRACT

A hole former assembly used to form a reusable hole former assembly used during the construction of a manhole base. The hole former assembly of the present invention aligns the center of the formed hole in the concrete manhole base sidewall with the center of an inlet or outlet opening of a canal bed liner embedded in the base of the manhole. The hole former assembly is suitable for use in either wet casting or dry casting the base of the manhole with the inlet and/or outlet of the invert embedded in a sidewall of the base of the manhole. Several of the component parts of the hole former assembly of the present invention may be molded as a single unit and thereafter separated, thereby reducing certain manufacturing costs of the component parts.

21 Claims, 5 Drawing Sheets

CONCRETE HOLE FORMER WITH EMBEDDED GASKET

1. FIELD OF THE INVENTION

This invention relates generally to a hole former assembly used to form a hole in a concrete sidewall, and more particularly relates to a reusable hole former assembly that aligns the center of the formed hole in the concrete sidewall with the center of an inlet or outlet opening of an invert embedded in the base of a manhole. The hole former assembly of the present invention is suitable for use in either wet casting or dry casting the base of the manhole with the inlet and/or outlet of the invert embedded in a sidewall of the base of the manhole. Several of the component parts of the hole former assembly of the present invention may be molded as a single unit and thereafter separated, thereby reducing certain manufacturing costs of the component parts.

BACKGROUND OF THE INVENTION

During the initial development of a community, a series of networked conduits are required to pipe sanitary sewage and storm sewage away from the community to, for example, a processing, treatment, or drainage site. Sanitary sewage and storm sewage systems are typically comprised of a plurality of networked pipelines that are buried in roadways deep enough to minimize the effects of heavy vehicles passing over the roadways and also deep enough (for example, below the frost line) to avoid the negative effects of freezing temperatures. In order to provide access to the pipeline for inspection and maintenance, manholes or catch basins are periodically interconnected within the networked pipelines. The manholes and/or catch basins are buried beneath the earth's surface, and typically below roadways, at depths of 10 feet or more.

When a manhole or catch basin is first constructed, it typically comprises a base, risers, cone, support frame and manhole cover or grate. The base includes a bottom with concentric sidewalls extending upward from the bottom. The lower portion of the base of the manhole is referred to as a canal-bed. The base of the manhole or catch basin structure may include one or more openings adapted to receive the pipeline, wherein the canal-bed includes a channel that directs fluid passing between the interconnected pipelines. This channel may be lined with a fluid impermeable invert or liner.

One or more hollow cylindrical risers rest atop the base sidewalls, thereby increasing the sidewall of the manhole to a desired height. The cone is hollow and is stacked atop the uppermost riser, wherein one end of the cone is sized to fit on top of the riser and the other end of the cone has a reduced diameter suitable for receiving and supporting the support frame on top of the cone.

The base, risers and cone of the manhole structures are typically comprised of mortared blocks or pre-cast with concrete and may weigh several tons. Of course, the overall size of the base, including the internal and external diameters of the base sidewalls affects both the cost to manufacture the base and the cost to construct the manhole. Thus, it is desirable to decrease the diameter of the base as much as practical. However, oftentimes communities will require that an unobstructed inner diameter of the base, risers, and access opening must be equal or exceed predefined minimums for rigidity, stability and access. Hence, the desire to reduce costs associated with the manhole may be limited by minimum size requirements.

Once the manhole or catch basin is constructed, fluids passing therethrough tend to deteriorate the structure. For example, sewage and putrid water are very acidic, and may comprise hydrogen sulfide and sulfuric acid. Over time, exposure to sewage or putrid water can damage the concrete of the canal-bed, base, and cone. In catch basins, road salt also has a similar affect on the canal-bed. This is due to the eventual breakdown of the concrete by the road salt, especially if the concrete is of poor quality. When repair or replacement of these manhole/catch basin structures is required, due to a deteriorated canal-bed, base or cone, the procedure is extremely expensive, time consuming, and difficult. A canal bed liner or invert reduces the amount of repairs and replacement of the underlying canal bed. The invert typically includes an inlet and/or outlet extending into the sidewall of the base. The connecting pipe extends through a hole formed in the sidewall and inserts into the opening of the inlet or outlet. When pre-casting the base, the weight of the wet or dry cast concrete tends to deform the opening of the inlet and/or outlet so that the connecting pipe does not insert and seal in the opening of the invert. Although iron casts or plugs have been used to form the hole in the sidewall during the casting process and reduce the deformation in the opening in the invert, the weight of the iron cast prohibits dry casting without deformation. Hence, there is a need for a hole forming assembling that reduces deformation during casting of the invert and the hole extending through the base sidewall.

A Casket may be utilized to seal the outer surface of the connecting pipe to the interior surface of the hole formed in the sidewall of the base, thereby preventing water from seeping into the base of the manhole through the hole formed in the sidewall. A portion of the gasket may be embedded into the concrete sidewall or an expansion ring may be utilized to press the gasket against the interior surface of the hole formed in the sidewall base. U.S. Pat. No. 4,565.347 issued to Ditcher, U.S. Pat. No. 4,916,799 issued to Skinner et al., and U.S. Pat. No. 5.624,123 issued to Meyers each describe a gasket, wherein a portion of the gasket is embedded into the interior surface of the hole formed in the sidewall base. For example, Ditcher describes a monolithic precast invert system, wherein a pin locks a gasket retainer assembly to the canal bed mold member. In order to remove the inner portion of the gasket retainer assembly described by Ditcher, the canal bed mold member must be removed. These references do not describe a hole former assembly suitable for embedding a gasket in the hole formed in the sidewall base in conjunction with lining the canal bed with a liner or invert. Hence, there is a need for a hole forming assembly that aligns with a liner of the canal bed and that may be removed from the formed hole after the base is cast. The present invention meets these and other needs that will become apparent from a review of the description of the present invention.

SUMMARY OF THE INVENTION

The present invention provides for a hole former assembly for forming a hole in a concrete sidewall during casting, wherein the hole is in alignment with the inlet or outlet opening of a canal bed liner. The hole former assembly of the present invention further holds a gasket in place during casting, wherein a portion of the gasket is embedded in the cured concrete inside the formed hole. In the preferred embodiment, the hole former assembly includes a first annular member, a second annular member, an invert alignment member, and a clamp assembly. The invert alignment member is adapted for engagement with the first annular member, wherein the invert alignment member engages either the inlet or outlet opening of the canal bed liner or invert prior to forming, the hole. The clamp assembly holds together the first annular member, second annular member and the invert alignment member. The gasket is held in place between the first and second annular members.

Without limitation, in the preferred embodiment the first and second annular members and the invert alignment member are molded as a single part and then subsequently separated. The material used to mold the part should resist bonding with concrete and not be degraded from contact with concrete. For example without limitation, a high molecular polyethylene or other polymeric material having the same or similar characteristics are particularly well suited materials.

The advantages of the present invention will become readily apparent to those skilled in the art from a review of the following, detailed description of the preferred embodiment especially when considered in conjunction with the claims and accompanying drawings in which like numerals in the several views refer to corresponding parts.

DETAILED DESCRIPTION

Figure 1:
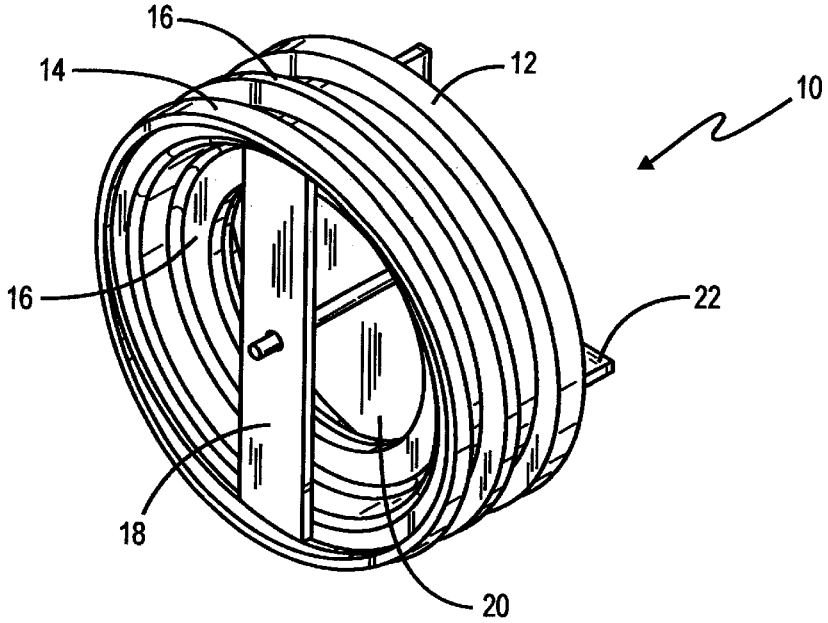
FIG. 1 is perspective view of the hole former assembly of the present invention.

The present invention represents broadly applicable improvements to the interconnection of an expansion line and main line of a sanitary sewage or storm sewage system. The embodiments detailed herein are intended to be taken as representative or exemplary of those in which the improvements of the invention may be incorporated and are not intended to be limiting. Referring first to FIG. 1 the hole former assembly 10 of the present invention is generally shown. The assembly includes an inner or first annular member 12, an outer or second annular member 14, a gasket 16 of known suitable construction, a bar 18 which forms a part of the clamp that firmly holds the gasket 16 between the inner annular member 12 and outer annular member 14, and an invert alignment member 20. The invert alignment member 20 includes tabs 22 extending outwardly from the invert alignment member. The invert alignment member 20 and tabs 22 are adapted for engaging the opening or sidewall 24 that forms the inlet or outlet of an invert liner 26 (see FIGS. 7 and 8).

Figure 2:
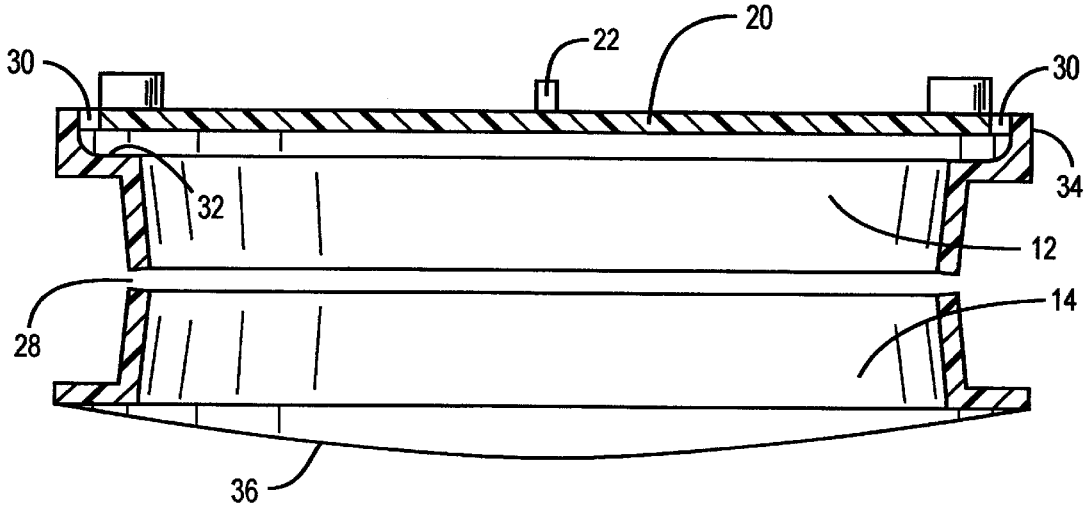
FIG. 2 is a partial sectional side elevational view of the inner and outer annular members and alignment members shown partially separated.
Figure 3:
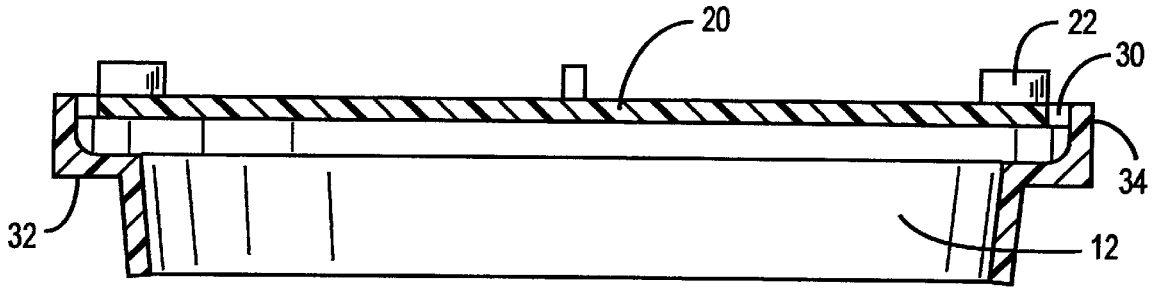
FIG. 3 is a partial sectional side elevational view of first or inner annular member and alignment member shown partially separated.
Figure 4:
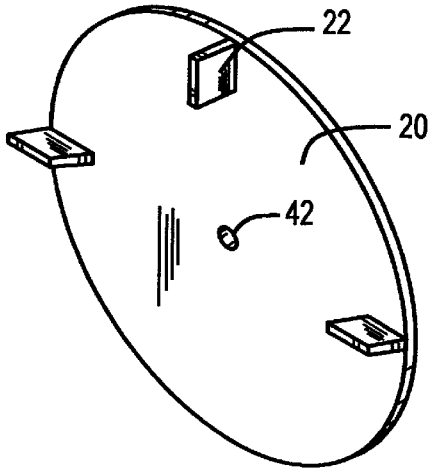
FIG. 4 is a perspective view of the alignment member of the hole former assembly of the present invention.
Figure 6:
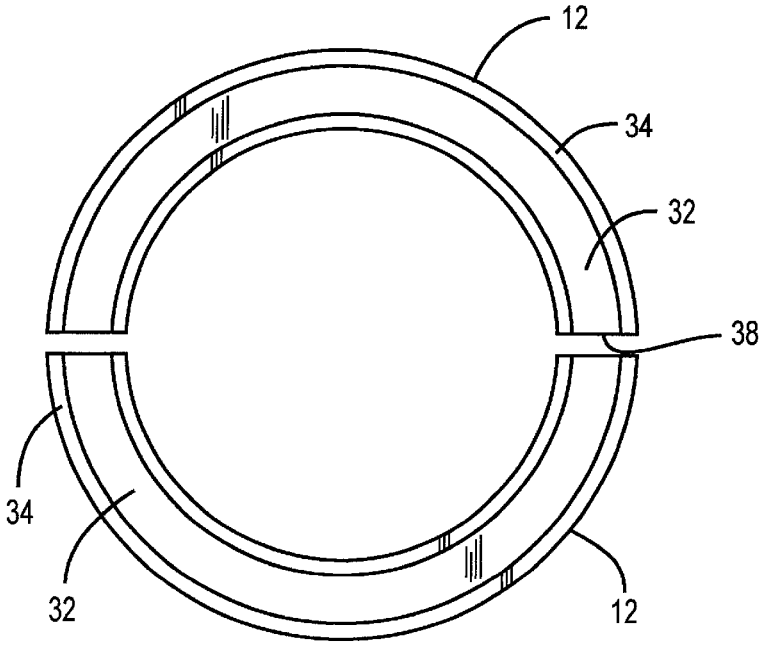
FIG. 6 is a top plan view of a segmented first annular member of the present invention.

Referring next to FIGS. 2 and 3 the inner annular member 12, outer annular member 14 and invert alignment member 20 are shown. In the preferred embodiment, the inner annular member 12, outer annular member 14 and invert alignment member 20 are molded as a unitary piece. The gap 28 between the inner annular member 12, outer annular member 14 is created by separating the members 12 and 14 by sawing, cutting, or other suitable means known in the art for dividing the members 12 and 14. Likewise, the invert alignment member 20 is separated from the inner annular member 12 to create the gap 30 (see also FIG. 4 which shows the invert alignment member 20 separated from the inner annular member 12. When the hole former is assembled, the invert alignment member 20 rests on the rim 32 of the inner annular member 12. The rim 32 extends outwardly from the first annular member 12 and may include a ledge 34 extending tangentially from the rim. The outer annular member 14 includes a convex outer edge 36, wherein the diameter of the convex outer edge 36 approximates the outer diameter of the curved sidewall in which the hole is formed. As shown in FIG. 6, the inner annular member 12 may be segmented, with gap 38, to ease removal of the inner annular member once the manhole base and hole therein are formed.

Figure 5:
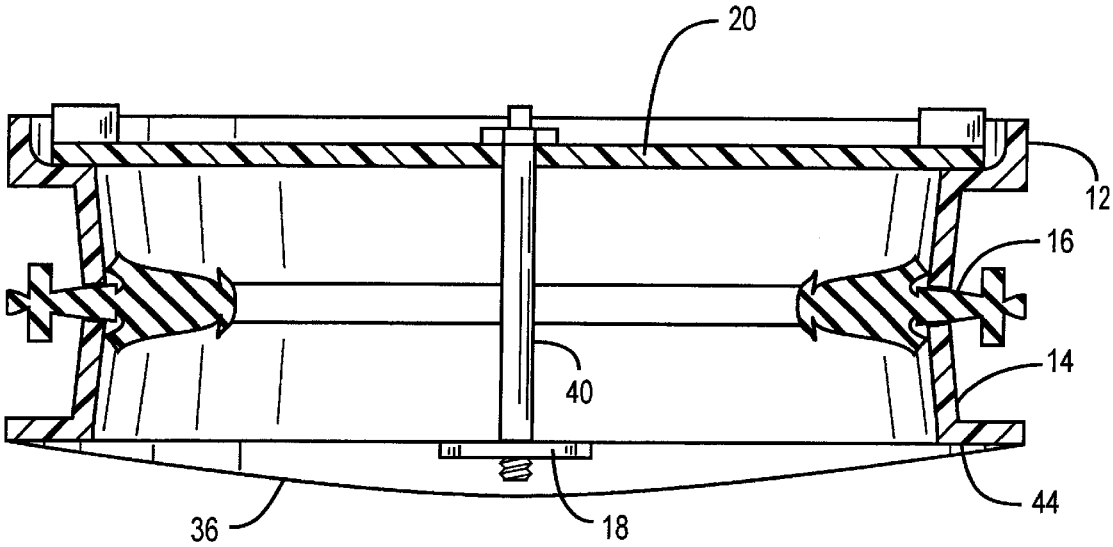
FIG. 5 is a partial sectional side elevational view of the hole former assembly of the type shown in FIG. 1.

Referring, next to FIG. 5, the preferred clamp assembly of the hole former assembly of the present invention is shown in greater detail. A bolt 40 extends through an aperture 42 formed in the invert alignment member and through an aperture formed in the bar 18 The ends of the bar 18 rest on a flange 44 extending outwardly from the outer annular member 14. A nut is tightened onto the threaded end of the bolt 40, thereby forcing inwards the inner and outer annular members 12 and 14 respectively and squeezing the gasket 16 therebetween.

Figure 7:
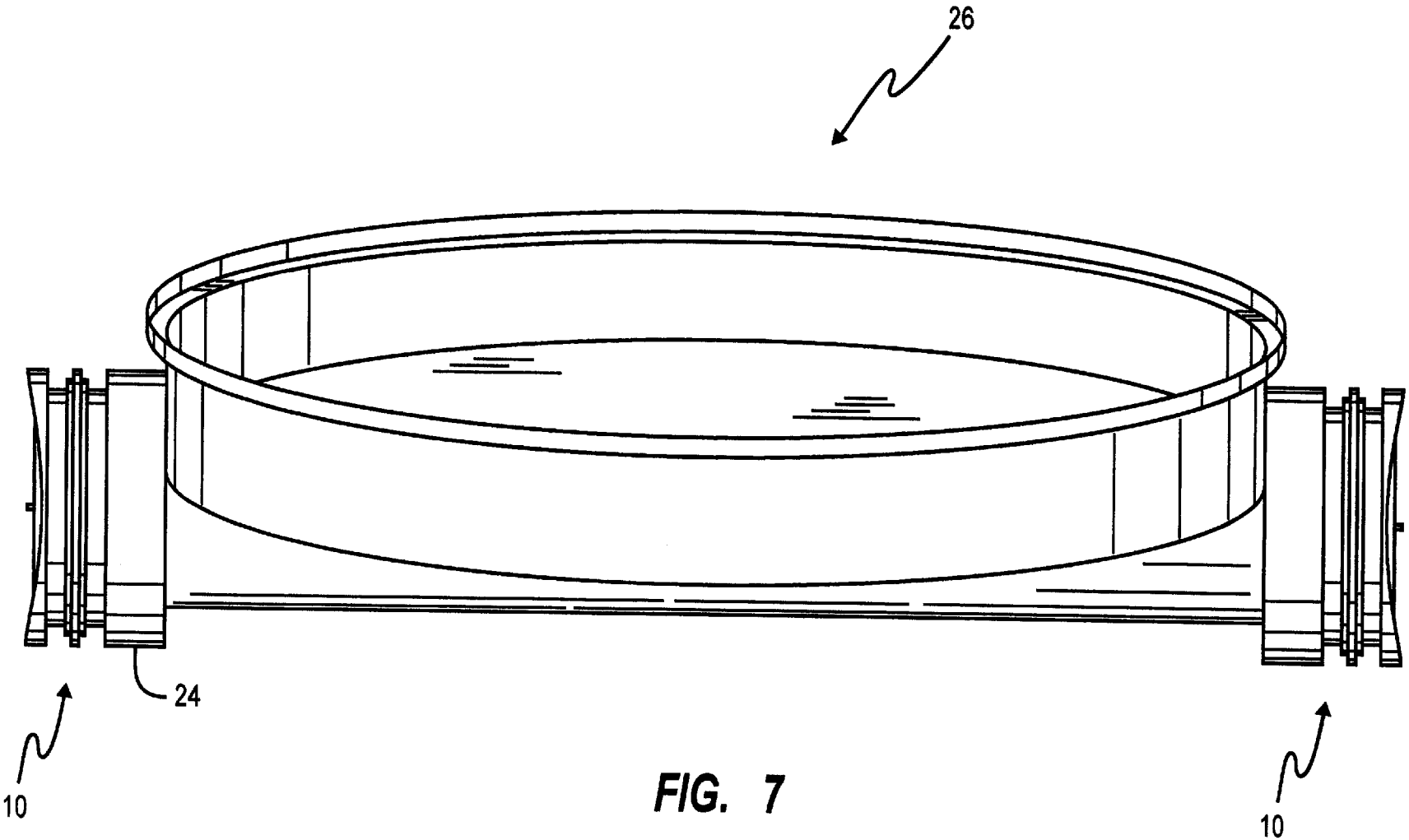
FIG. 7 is a perspective view of hole former assemblies of the present invention shown aligned and inserted in the inlet and outlet openings of a canal bed liner.
Figure 8:
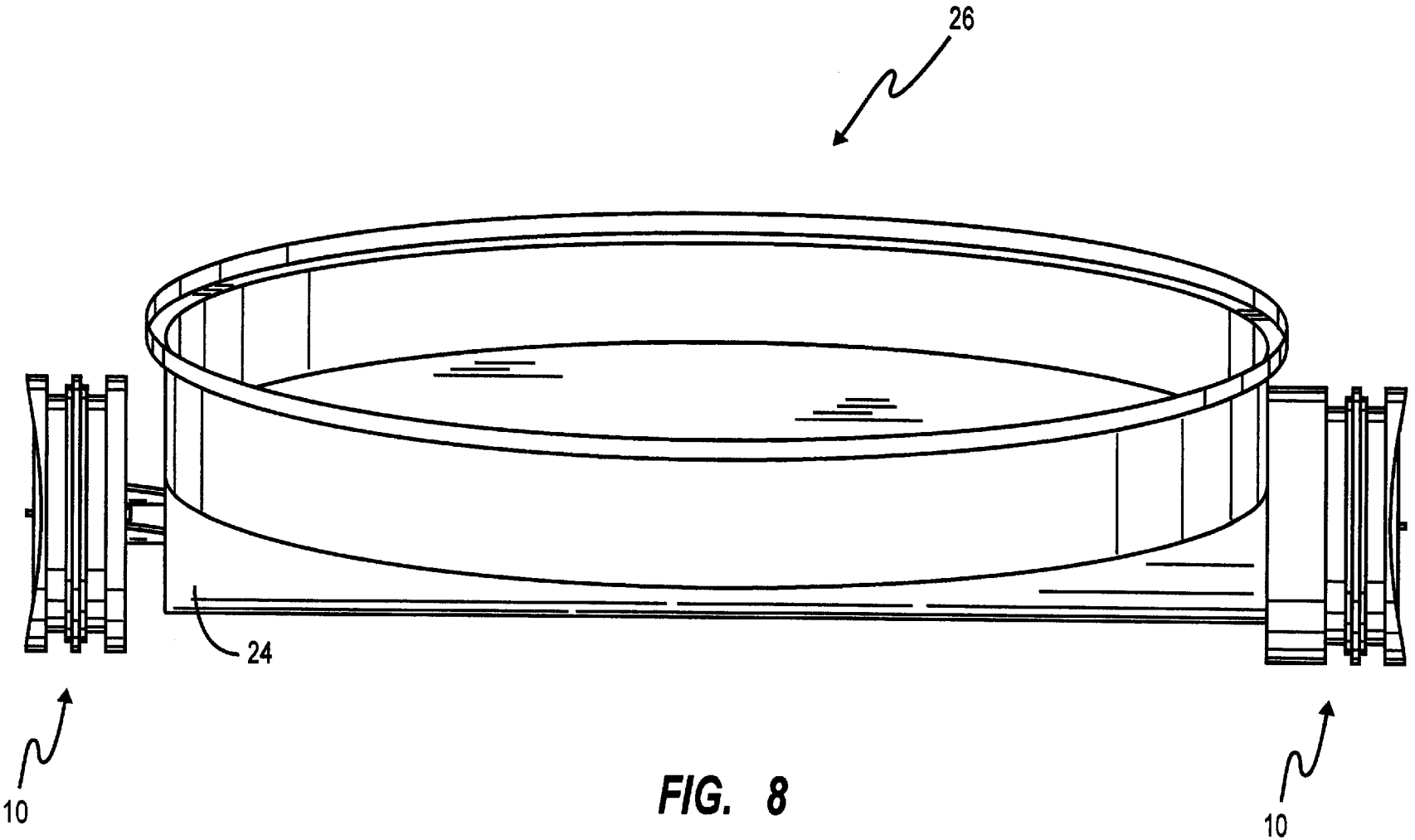
FIG. 8 is a perspective view of hole former assemblies of the present invention shown aligned in the inlet opening and inserted in the outlet opening of a canal bed liner.

Having described the constructional features of the present invention, the mode of use will next be presented in conjunction with a description of FIGS. 7 and 8. The inner annular member 12, outer annular member 14, invert alignment member 20, and gasket 16 are clamped together to comprise the hole former assembly 10. The hole former assembly 10 is aligned with the sidewall opening 24 in the invert 26. The hole former assembly 10 is engaged with the invert 26, wherein the tabs 22 extend into the opening and positively align the hole former assembly 11 with the opening 24. As shown in FIG. 7, the ledge 34 may lit into and engage the inner portion of the sidewall opening 24. The invert 26 and hole former assembly 10 are then positioned within a form/mold for forming the manhole base. The manhole base may then be either wet or dry cast. Once the concrete of the manhole base is stable the forms are removed. The bolt 40 is removed and the outer annular ring includes a slight taper so that it pulls easily out of the formed hole. The alignment member 20 and inner annular ring 12 (having a slight taper for ease of removal) are pulled towards the center of the manhole base out the opening 24 in the manhole. As described above, the inner annular ring 12 may be segmented to thereby aid in the ease of removing the inner annular member 12 from between the embedded gasket 16 and the embedded invert 26. The inner annular member 12, outer annular member 14 and invert alignment member 20 may be reassembled for use in forming another manhole base having a gasket and invert at least partially embedded in the concrete manhole base. Alternatively, the alignment member 20 may be removed and the inner annular member 12 may be left in place to thereby limit tile flexibility of the gasket 16 when a pipe is engaged therewith.

This invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices, and that various modifications, both as to the equipment and operating procedures, can be accomplished without departing from the scope of the invention itself.

What is claimed is:

1. A hole former assembly for forming a hole in a concrete sidewall during casting, wherein a portion of a gasket is embedded in the cured concrete inside the formed hole, said hole former comprising:

a first annular member;

a second annular member;

an invert alignment member adapted for engagement with said first annular member, wherein said invert alignment member is adapted to engage at least one of an inlet and outlet of an invert prior to forming said hole; and a clamp that holds together the first annular member, second annular member and the invert alignment member, wherein a gasket may be held in position between the first and second annular members.

2. The hole former as recited in claim 1, further including a rim extending outwardly from the first annular member, wherein said invert alignment member rests on said rim.

3. The hole former as recited in claim 2, further including a ledge extending tangentially from said rim.

4. The hole former as recited in claim 1, wherein said invert alignment member includes tabs extending outwardly from said invert alignment member and adapted for engaging the sidewalls forming at least one of the inlet and outlet.

5. The hole former as recited in claim 1, wherein an outer edge of said second annular member is convex having a diameter approximating a diameter of a curved sidewall in which the hole is to be formed.

6. The hole former as recited in claim 1, wherein said first and second annular members are molded as a single part and then divided apart.

7. The hole former as recited in claim 1, wherein said first and second annular members and said invert alignment member are molded as a single part and then subsequently separated.

8. The hole former as recited in claim 1, wherein said first annular member is segmented.

9. A hole former assembly for forming a hole in a concrete sidewall during casting, wherein a portion of a gasket is embedded in the cured concrete inside the formed hole, said hole former comprising:

a first annular member;

a second annular member;

an invert alignment member adapted for engagement with said first annular member, wherein said invert alignment member is adapted to engage at least one of an inlet and outlet of an invert prior to forming said hole; and a clamp that holds together the first annular member, second annular member and the invert alignment member, wherein a gasket may be held in position between the first and second annular members, said first and second annular members being molded as a single part and then divided apart.

10. The hole former as recited in claim 9, further including a rim extending outwardly from the first annular member, wherein said invert alignment member rests on said rim.

11. The hole former as recited in claim 10, further including a ledge extending, tangentially from said rim.

12. The hole former as recited in claim 9, wherein said invert alignment member includes tabs extending outwardly from said invert alignment member and adapted for engaging the sidewalls forming at least one of the inlet and outlet.

13. The hole former as recited in claim 9, wherein an outer edge of said second annular member is convex having a diameter approximating a diameter of a curved sidewall in which the hole is to be formed.

14. The hole former as recited in claim 9, wherein said first and second annular members and said invert alignment member are molded as a single part and then subsequently separated.

15. The hole former as recited in claim 9, wherein said first annular member is segmented.

16. A hole former assembly for forming a hole in a concrete sidewall during casting, wherein a portion of a gasket is embedded in the cured concrete inside the formed hole, said hole former comprising:

a first annular member;

a second annular member;

an invert alignment member adapted for engagement with said first annular member, wherein said invert alignment member is adapted to engage at least one of an inlet and outlet of an invert prior to forming said hole; and a clamp that holds together the first annular member, second annular member and the invert alignment member, wherein a gasket may be held in position between the first and second annular members, said first and second annular members and said invert alignment member being molded as a single part and then subsequently separated.

17. The hole former as recited in claim 16, further including a rim extending outwardly from the first annular member, wherein said invert alignment member rests on said rim.

18. The hole former as recited in claim 17, further including a ledge extending tangentially from said rim.

19. The hole former as recited in claim 16, wherein said invert alignment member includes tabs extending outwardly from said invert alignment member and adapted for engaging the sidewalls forming at least one of the inlet and outlet.

20. The hole former as recited in claim 16, wherein an outer edge of said second annular member is convex having a diameter approximating a diameter of a curved sidewall in which the hole is to be formed.

21. The hole former as recited in claim 16, wherein said first annular member is segmented.

* * * * *